US008720989B2

(12) United States Patent
Jurcic et al.

(10) Patent No.: US 8,720,989 B2
(45) Date of Patent: May 13, 2014

(54) CONVERTIBLE CHAIR

(75) Inventors: Brian Jurcic, Bacchus Marsh (AU); Susan Kay Thomas, Bacchus Marsh (AU); Robert Ian Edgar, Wheelers Hill (AU); Jessejames Marinas, Hampton Park (AU); Rebecca Anne Cox, Warragul (AU)

(73) Assignees: Brian Jurcic, Bacchus Marsh (AU); Susan Kay Thomas, Bacchus March (AU)

( * ) Notice: Subject to any disclaimer, the term of this patent is extended or adjusted under 35 U.S.C. 154(b) by 141 days.

(21) Appl. No.: 12/092,467

(22) PCT Filed: Nov. 2, 2006

(86) PCT No.: PCT/IB2006/003097

§ 371 (c)(1),
(2), (4) Date: Jan. 28, 2009

(87) PCT Pub. No.: WO2007/052140

PCT Pub. Date: May 10, 2007

(65) Prior Publication Data

US 2009/0261630 A1 Oct. 22, 2009

(30) Foreign Application Priority Data

Nov. 2, 2005 (AU) ..... 2005906043

(51) Int. Cl.
*A47C 13/00* (2006.01)
*A47B 85/04* (2006.01)

(52) U.S. Cl.
USPC ..... 297/122; 297/118; 297/119; 297/124

(58) Field of Classification Search
USPC ..... 297/118, 119, 122, 123, 124
See application file for complete search history.

(56) References Cited

U.S. PATENT DOCUMENTS

| | | | | | |
|---|---|---|---|---|---|
| 1,307,420 | A | * | 6/1919 | Schmidt | 297/124 |
| 1,928,890 | A | * | 10/1933 | Haney et al. | 297/122 |
| 1,937,886 | A | * | 12/1933 | Grose | 182/33 |
| 2,060,000 | A | * | 11/1936 | Nelson | 297/122 |
| 2,888,062 | A | * | 5/1959 | Lockwood | 297/122 |
| 5,352,013 | A | * | 10/1994 | Rusyniak | 297/119 |
| 5,507,549 | A | | 4/1996 | Cope | |
| 5,833,306 | A | | 11/1998 | Breto | |
| 6,125,487 | A | * | 10/2000 | Ive | 5/655 |
| 6,619,734 | B2 | * | 9/2003 | Helmsderfer | 297/130 |
| 6,694,552 | B1 | * | 2/2004 | Vickers | 5/655 |

FOREIGN PATENT DOCUMENTS

| | | | |
|---|---|---|---|
| AU | 686519 | * | 3/1997 |
| AU | 200244373 | B2 | 12/2002 |
| CN | 1074360 | A | 7/1993 |

* cited by examiner

*Primary Examiner* — Philip Gabler
(74) *Attorney, Agent, or Firm* — Hogan Lovells US LLP

(57) ABSTRACT

A furniture item (102) convertible between a chair and a table. It has two panels (104, 106) hinged together and moveable between: —a chair configuration, in which one panel (104) provides a seat and the other panel (106) provides a backrest, and—a table configuration, in which the panels form a table top. A moveable support member (114) is rotatable between a stowed position beneath one panel (104) when in the chair configuration to a raised position in which the moveable support member (114) provides support to the underside of one panel (104) and support to the hinge (105).

13 Claims, 18 Drawing Sheets

CONVERTIBLE CHAIR

This application is the U.S. National Phase under 35 U.S.C. §371 of International Application PCT/IB2006/003097, filed on Nov. 2, 2006, which claims priority to Australian Patent Application No. 2005906043, filed on Nov. 2, 2005. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

FIELD OF THE INVENTION

This invention concerns an item of furniture which is capable of converting from a chair to a table. The table can function as a conventional table surface, but is particularly adapted for use as an ironing board or as table for changing the nappy or clothing on a baby.

BACKGROUND TO THE INVENTION

It is known to construct a chair which can convert into an ironing table. Examples of these described in U.S. Pat. Nos. 5,507,549 and 5,833,306 and Australian patent 686519. While the constructions described in the prior art may be suitable for hand building and sale in small numbers, they are not applicable to mass production or low cost shipping because of their size, complexity and/or inability to be broken down for flat pack shipping.

An aim of the present invention is to provide a chair which is convertible to a table and which overcomes these difficulties.

SUMMARY OF THE INVENTION

In a first aspect the invention provides a furniture item convertible between a chair configuration and a table configuration, said furniture item comprising:

- a first panel portion hinged to a second panel portion at respective hinged edges, said panel portions being moveable between:
  - respective first positions, when in said chair configuration, in which said first panel portion adopts a generally horizontal orientation to provide a seat for a user to sit upon and said second panel portion adopts a generally upright orientation to provide a backrest for said seated user to lean against, and
  - respective second positions, when in said table configuration, in which said panel portions align to form a table top having a substantially flat upper surface; and
- a rigid frame extending behind said second panel portion when in said chair configuration, and extending under said second panel portion when in said table configuration,
- a pivotal connection connecting said frame and said second panel portion whereby said second panel portion may be tilted thereby raising or lowering said first panel portion between its said first and second positions,
- a moveable support means comprising:
  - a first strut attached by a rotary connection to said frame, said rotary connection having an axis of rotation,
  - a second strut rigidly attached to that end of said first strut distal from said rotary connection, said first and second struts lying in the same plane of rotary motion orthogonal to said axis of rotation,
- said moveable support means being rotatable between a stowed position beneath said first panel portion when in the chair configuration and a raised position in which said moveable support member provides support to the underside of said first panel portion and support to said hinge.

A panel retention means may be located at that end of said second strut distal from said first strut, said panel retention means including:

- an aperture which receives a protrusion extending from said second panel portion, and
- a flange which extends between said panel portions at the hinge;

whereby, when in said table configuration, upward movement of the second panel portion is prevented by said protrusion in said aperture and movement of said second strut is resisted by said flange being clamped between said hinged edges of said panel portions.

Cooperating projections and recesses may be provided on said frame and said first panel portion whereby, when in said chair configuration, said protrusions and recesses inter-engage to resist forward sliding of said first panel portion.

A raised abutment may be provided on said first strut whereby, when in said chair configuration, said first strut engages a clip which would permit sliding of said first strut within said clip except that said abutment abuts the clip to thereby resist forward sliding of said first panel portion. A basket or bin like receptacle may be suspended from said frame when in said table configuration.

The invention may also provide the combination of a furniture item as described above, when in said chair configuration, together with a child's height raising seat held against said first panel portion, said frame having fastened by threaded fasteners thereto at least one pair of straps carrying inter-engaging quick release fastenings, said height raising seat being held against said first panel portion by said straps tensioned and fastened together.

The furniture item may have a fitted fabric cover covering together said first and second panel portions, said cover having, when viewed in the table configuration:

- a single piece panel covering the top faces of the panel portions,
- a multi-piece rear panel on its underside,
- an edge panel extending around the perimeter of said cover and joining the upper panel to the rear panel, and
- a pair of elongated fasteners joining edges of said pieces of the rear panel.

The invention may also provide the combination of a furniture item as defined above, when in said table configuration, together with an attached overlay for use when changing the clothing of a baby, said overlay comprising:

- a cover portion adapted to cover said table surface,
- a skirt portion which hangs down from edges of the table around one end of the table,
- elastic edges on the cover portion towards the other end of the table which stretch the cover from beneath the table,
- bolster structures fastened to the cover in a position to prevent the baby rolling sideways off the table; and
- pockets in the skirt portion.

The overlay may be held in place on the table surface by a releasable belt the ends of which extend from two edges of the cover portion and which are releasably fastened below said table top. Straps may extend from the cover portion at the bolster structures whereby the straps may be releasably fastened in order to secure the baby onto the table. The releasable fastening of said belt and/or said straps may be by VELCRO® type hook and pile fastenings.

When in said chair configuration, a panel suitable for supporting reading or writing material may be supported in front of the chair by said moveable support means.

In another aspect the invention may provide a kit of parts supplied in a flat pack and suitable for self assembly by the end user into a furniture item which is convertible between a chair configuration and a table configuration, said kit comprising:

- a pair of side frames each including:
  - a pair of side legs of the chair,
  - a generally upright frame portion which supports a backrest of the chair configuration, and
  - a forward extending frame portion which lays beneath a seat of the chair configuration;
- a rigid link for joining said side frames to each other,
- a first panel portion hinged to a second panel portion at respective hinged edges, said second panel portion including a first rotary connection, said first rotary connection adapted for attachment to and between first corresponding ends of said side frames, and
- a moveable support means including a second rotary connection, said second rotary connection adapted for attachment to and between second corresponding ends of said side frames.

In another aspect the invention may provide a method of assembling a furniture item from the kit of parts described above, said method comprising:

- fastening said first corresponding ends of said side frames to respective ends of said first rotary connection,
- fastening said second corresponding ends of said side frames to respective ends of said second rotary connection,
- fastening said rigid link to each side frame about midway between said rotary connections, and
- tightening said fastenings while ensuring the rotary connections are free to rotate.

BRIEF DESCRIPTION OF THE DRAWINGS

In order that the invention may be more fully understood there will now be described, by way of example only, preferred embodiments and other elements of the invention with reference to the accompanying drawings where.

DESCRIPTION OF THE PREFERRED EMBODIMENT AND OTHER EXAMPLES OF THE INVENTION

Figure 2:
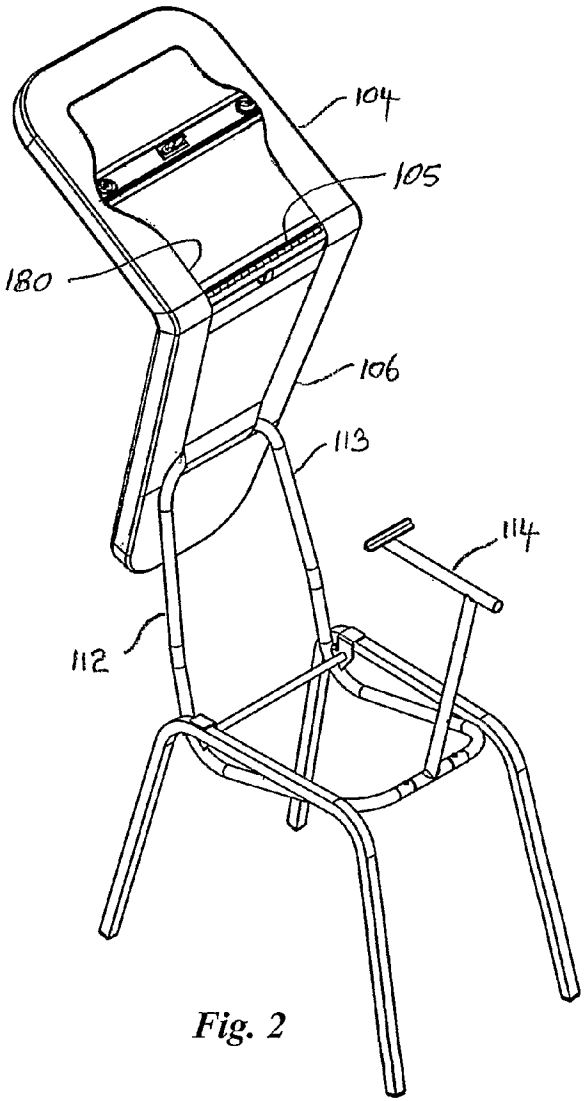
FIG. 2 is a first isometric view of the furniture item in FIG. 1 part-way through its conversion from a chair configuration to a table configuration.
Figure 1:
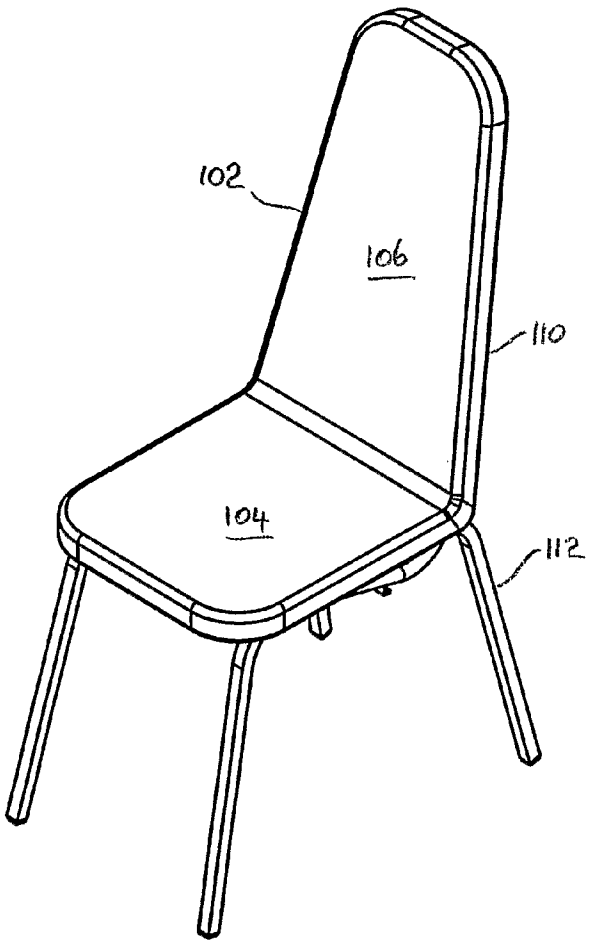
FIG. 1 is an isometric view of a furniture item having the form of a convertible chair according to a first embodiment of the present invention.
Figure 3:
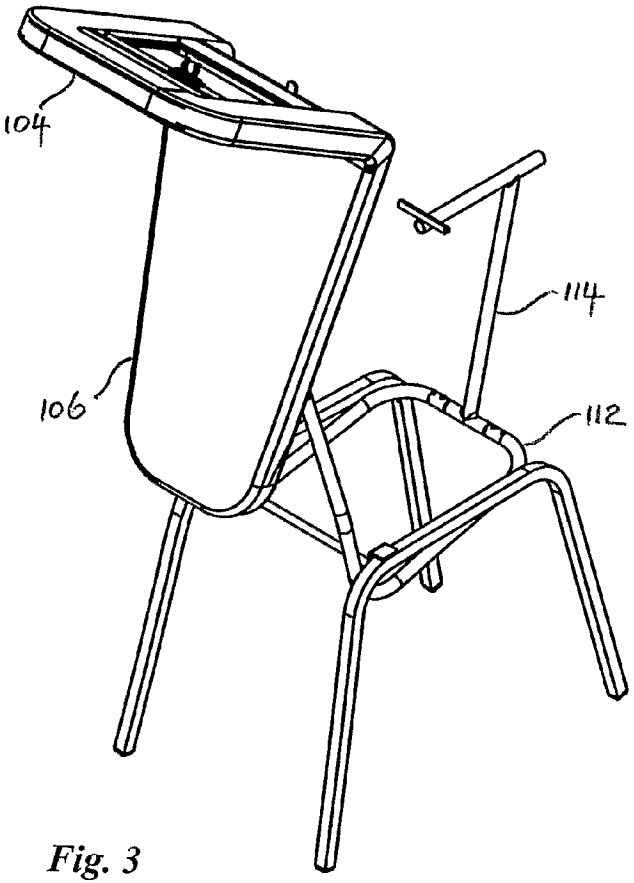
FIG. 3 is a second isometric view of the furniture item in FIG. 2.
Figure 4:
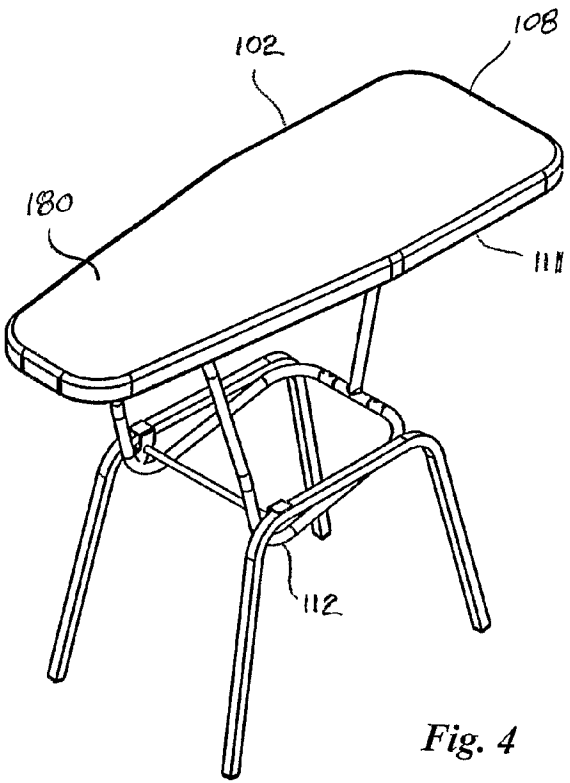
FIG. 4 is a isometric view of the furniture item in FIGS. 1-3 having completed its conversion from a chair configuration to a table configuration.
Figure 5:
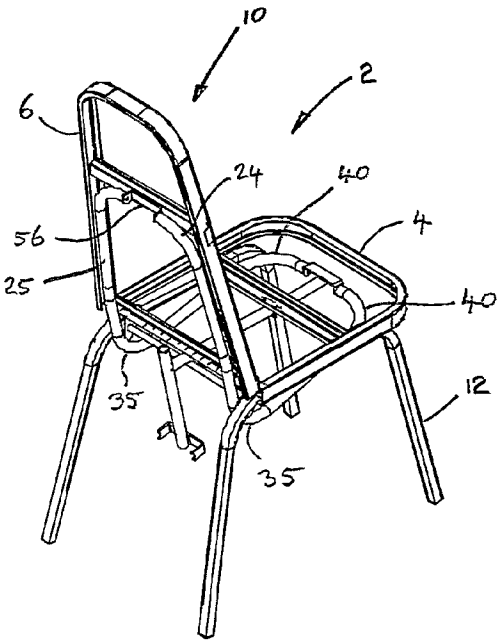
FIG. 5 is an isometric view of the main structural components of a convertible chair according to a second embodiment of the present invention.
Figure 8:
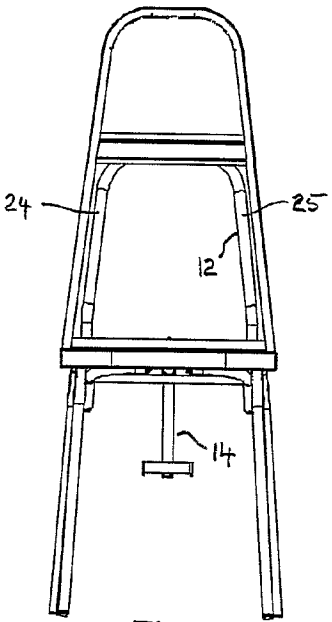
FIG. 8 is a front view of the construction shown in FIG. 5.
Figure 6:
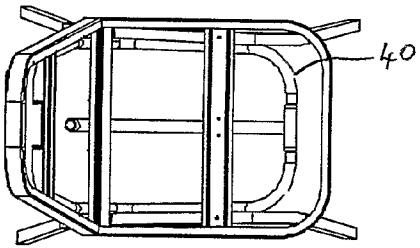
FIG. 6 is a view looking down upon the construction shown in FIG. 5.
Figure 7:
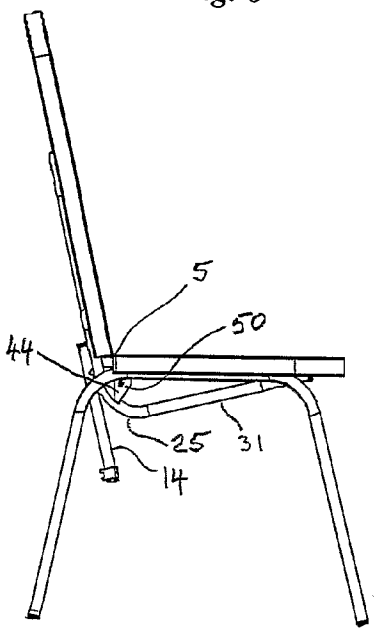
FIG. 7 is a side view of the construction shown in FIG. 5.
Figure 9:
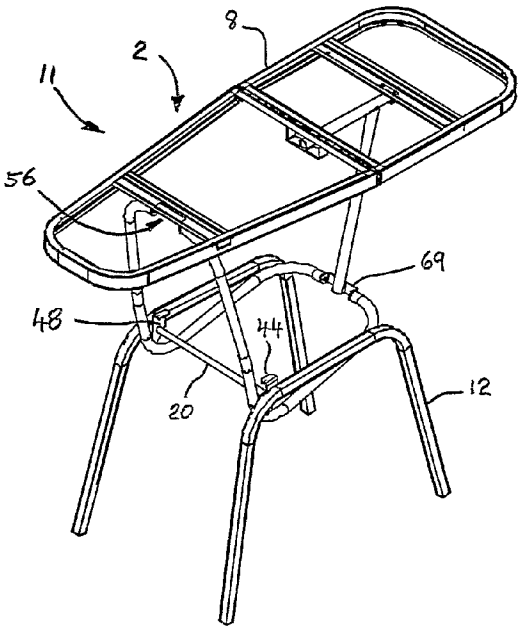
FIG. 9 is an isometric view of the structural framework shown in FIG. 5 but with the components moved to convert it into a table.
Figure 12:
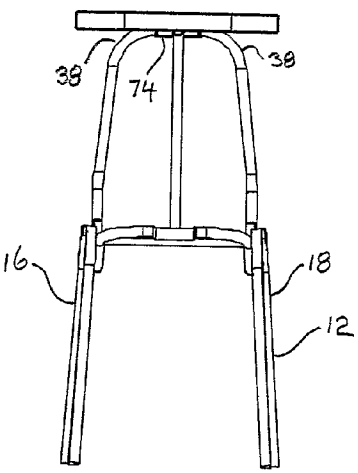
FIG. 12 is a front view of the construction in FIG. 9.
Figure 10:
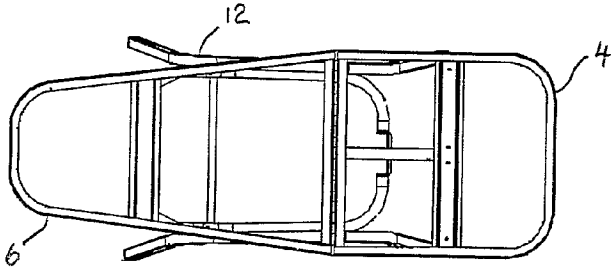
FIG. 10 is a view looking down from above on the construction shown in FIG. 9.
Figure 11:
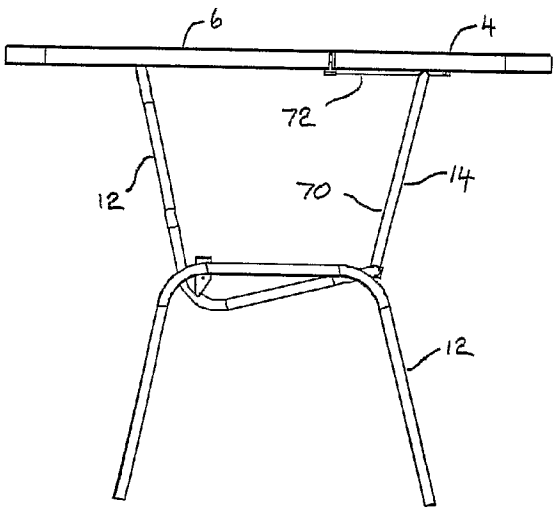
FIG. 11 is a side view of the construction in FIG. 9.

The furniture item 102 shown in FIGS. 1 to 4 is an appliance which comprises a main frame 112, a movable support member 114, a seat panel 104 and a backrest panel 106. In FIG. 1 the appliance 102 has the configuration of a chair 110 while in FIG. 4 the appliance 102 has the configuration of a table 111 which is particularly suited for use when ironing clothing. The seat panel 104 and a backrest panel 106 are covered by a fabric cover 180 which extends over both panels.

The seat panel 104 is connected by a hinge 105 to the backrest panel 106 in such a way that the seat panel 104 can be raised and the backrest panel 106 tilted so that they together form a table top 108 which is supported by the upper portion 113 of the main frame 112 and a movable support member 114 which rotates into position to support the panels 104 and 106.

The furniture item 2 illustrated by FIGS. 5 to 13 is an appliance which similarly comprises a main frame 12, a movable support member 14, a seat panel 4 and a backrest panel 6. For clarity of illustration, FIGS. 5 to 13 show the appliance 2 without mesh panels and the cushioning and fabric covering which would be present on the seat panel 4 or backrest panel 6 when in use. The mesh panels are shown in FIGS. 15 to 20 and the fabric covering is the same as that shown in FIGS. 1 to 4 and 26.

The seat panel 4 is connected by a hinge 5 to the backrest panel 6 and can be raised and the backrest panel 6 tilted so that they together form a tabletop 8 supported by the support member 14 generally as for the embodiment described above. The hinged edges 98 and 99 of the panels 4 and 6 respectively are separated only by the thickness of the hinge.

The main frame 12 has two side frames 16 and 18, which are minor images of each other, and a connecting bar 20. Each side frame 16 and 18 has a lower portion 21 and 22 respectively bent from square steel tube into a U shape to form side legs 26, 27 and 28, 29 respectively, each pair of said side legs being connected by an upper rail portion 23 of the respective lower portion 21, 22. Upper portions 24 and 25 of the side frames 16 and 18 are bent from round steel tube into a form having a generally straight portion 31 joined to a further generally straight portion 33 by a central curved portion 35. The upper portions 24 and 25 bend at a curve 38 near the top of the frame to form a short straight portion 37 oriented horizontally. The upper portions 24 and 25 bend at a curve 40 near the front of the frame to form a short straight portion 39 directed horizontally. The short straight ends 37 and 39 extend by way of their respective adjacent curves 38 and 40 respectively out of the plane of portions 31, 33 and 35, but do not extend very far out of that plane. Each side frame 16 and 18 therefore is not very deep, being only about 40% of the width of the chair 10, thus lending itself to flat pack packaging for storage and shipment.

The respective top ends 37 are not joined directly together, nor are the bottom ends 39. They are instead linked by respective U-shaped brackets 56 and 69, the connections of which provide for rotary movement of the brackets 56 and 69 and which are described later in this specification. The brackets 56 and 69 thereby provide rotary connections.

Each lower portion 21 and 22 of respective side frames 16 and 18 is welded to its respective upper portion 24 and 25 near the curve 35 and at the curve 40.

Welded to each lower portion 21, 22 is a bracket 44 which carries a hole 46 in its side face 48. The connecting bar 20 carries an internally threaded portion at each end which is fastened through the hole 46 by a screw 50. Alternatively the bar 20 could have external threaded portions at each end and be fastened by nuts.

The top ends 37 of opposing upper portions 24 and 25 are connected via a U-shaped bracket 56 attached to a backrest panel 6. The bracket 56 is rigidly attached to the backrest panel but the bracket 56 is fastened at each of its ends to a respective top end 37 in a manner that provides for easy rotary movement about fastenings fitted into the top ends 37. The backrest panel 6 simply tilts up and down as the configuration of the appliance 2 is changed respectively from chair to table and back to chair again.

The seat panel 4 is not attached directly to the main frame 12 of the chair in either its raised or lowered position. The seat panel is instead connected to the top of the frame via the hinge 5 and backrest panel 6. The seat panel 4 rests upon the upper rails 23 of the lower portions 21 and 22 of the side frame when in the lowered position and on the movable support member 14 when in the raised position.

Figure 14:
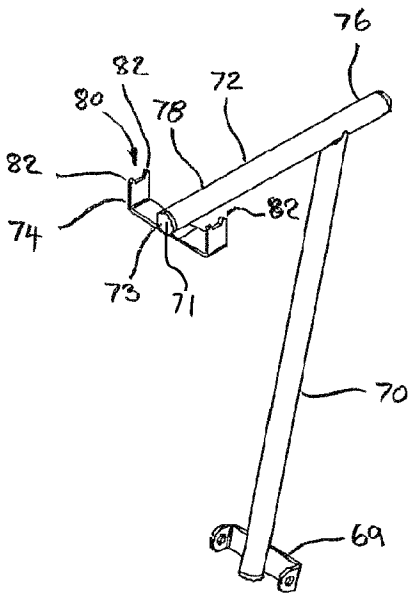
FIG. 14 is a detailed view of a support member incorporated into the convertible chair in FIG. 5.
Figure 13:
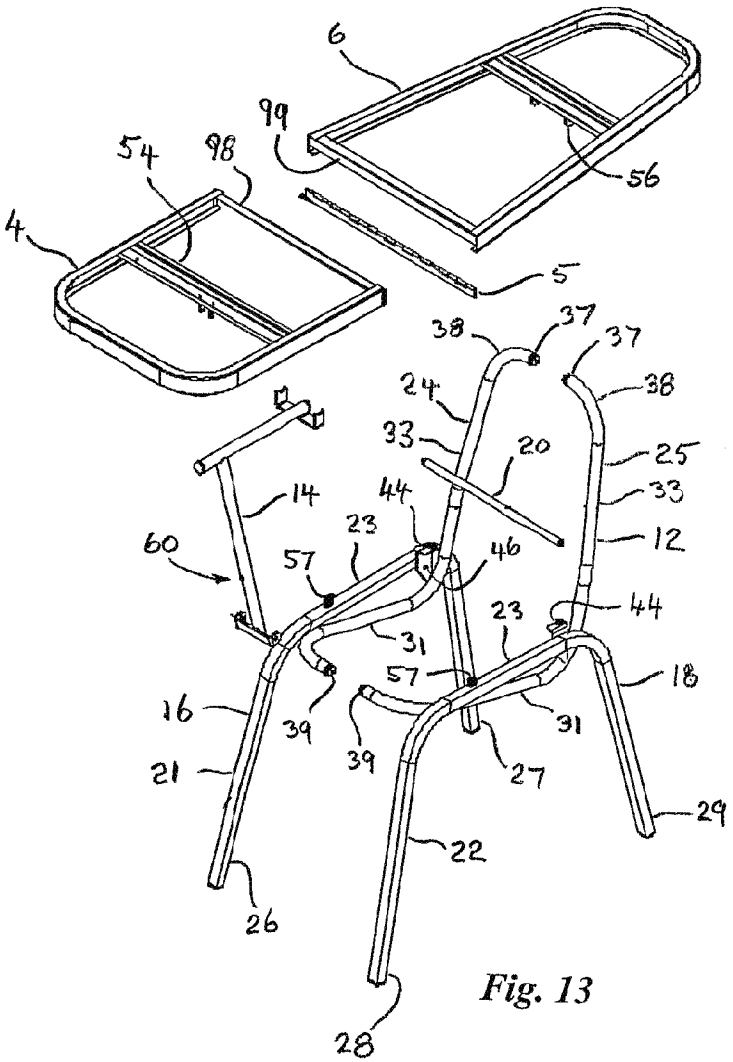
FIG. 13 is an exploded view of the framework shown in FIG. 9.

The movable support member 14 is shown in detail in FIG. 14. It has a strut 70 which is aligned in the plane of symmetry running down the centre of the chair. One end of the strut 70 is welded to a second shorter strut 72, part-way along the shorter strut, at an angle of about 80°. The shorter strut 72 thus has a short portion 76 which extends for a short distance to one side of the long strut 70, and a longer portion 78 which extends in the opposite direction until, at its end 73 with aperture 71, it is welded to a U-shaped locating bracket 74.

In use the long strut 70 swings upon the bracket 69 from a horizontal position when the appliance has adopted the form of a chair, to a position which is angled at about 10° from vertical when the appliance is converted to the form of a table. Likewise the shorter strut 72 swings to horizontal when the tabletop is raised, and drops to approximately 20° to the vertical when the chair form is adopted.

Figure 15:
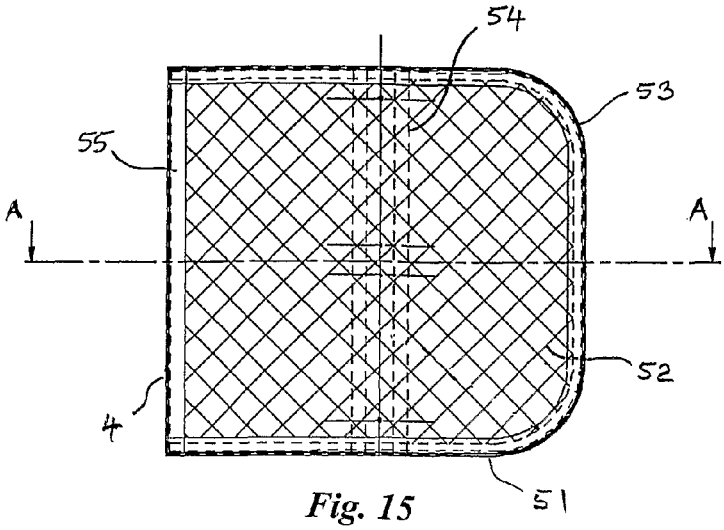
FIG. 15 is a view looking down upon a portion which forms the seat panel of the chair in FIG. 5.
Figure 16:
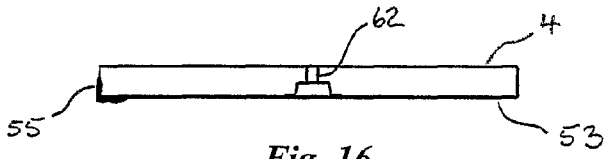
FIG. 16 is a cross section view through plane A-A shown in FIG. 15.
Figure 17:
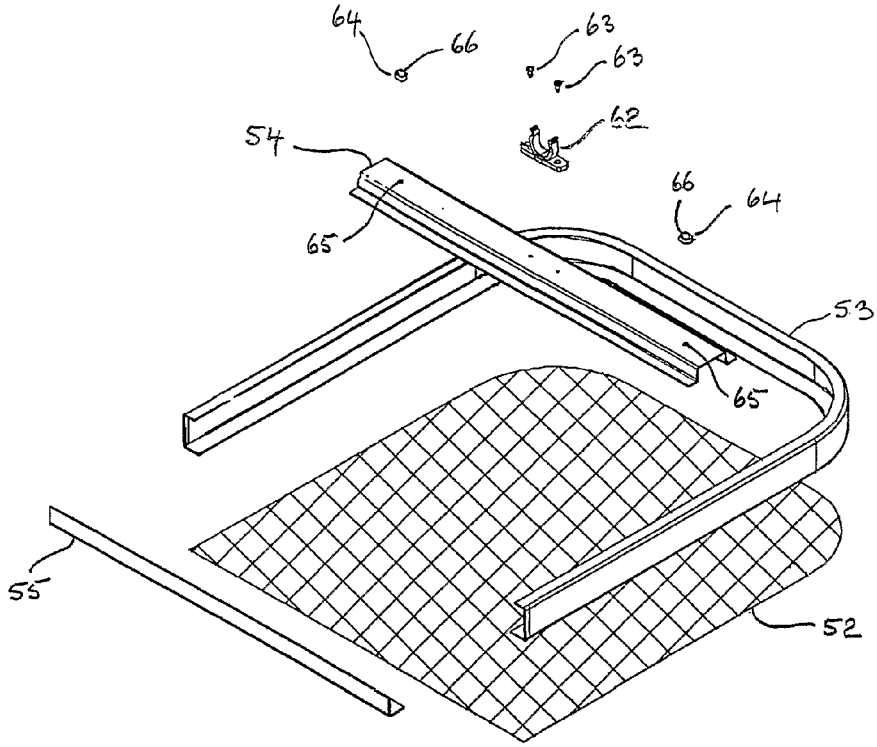
FIG. 17 is an exploded view of the seat panel in FIG. 15.

As seen in FIGS. 15 to 17, the seat panel 4 comprises a perimeter frame 51 with a mesh panel 52 and a reinforcing member 54 attached thereto. The perimeter frame has a continuous U-shaped portion 53 formed from thin-wall channel section sheet metal extending around the two sides and front of the seat panel and a straight, angle-section thin metal portion 55 at the rear of the seat panel. A straight length of thin-wall hat-section steel extends as the strengthening reinforcing cross member 54 from one arm of frame portion 53 to the other arm of frame portion 53. The perimeter frame portions 53 and 55 are welded to each other at their ends and also welded to the mesh panel 52 and the cross member 54 in order to form a rigid unitary seat panel construction.

Figure 18:
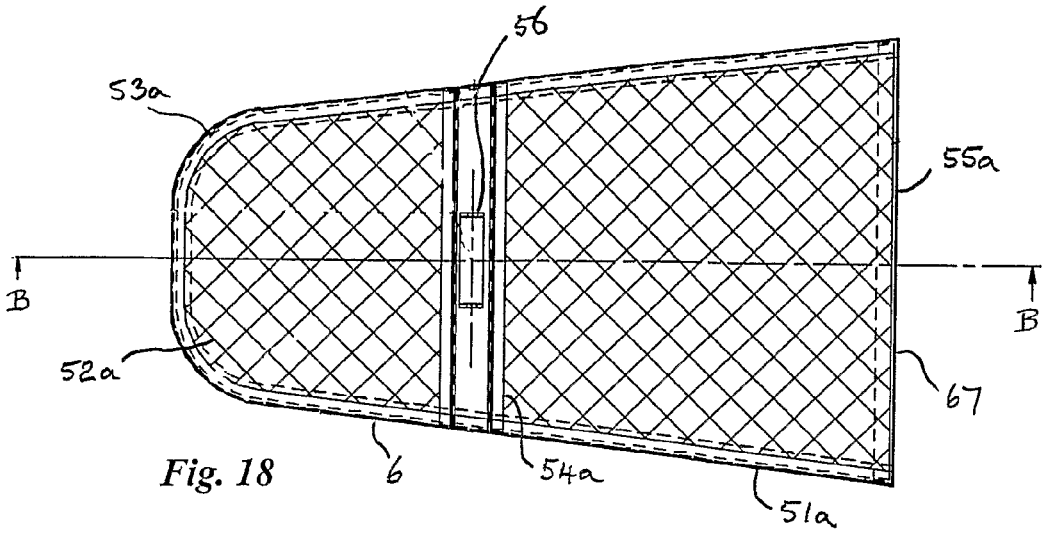
FIG. 18 is a view from the rear/underneath of a panel which forms the backrest portion of the chair in FIG. 5.
Figure 19:
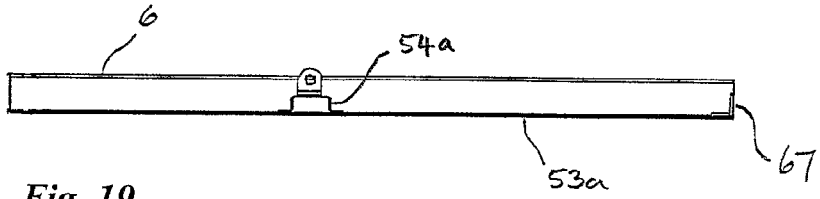
FIG. 19 is a cross section view of through plane B-B shown in FIG. 18.
Figure 20:
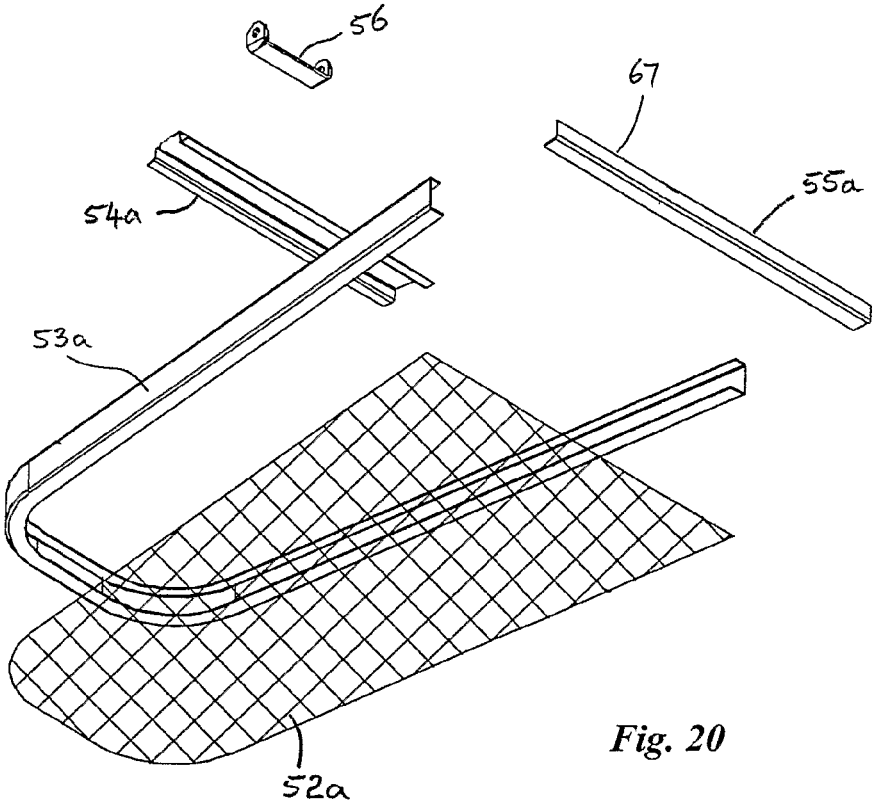
FIG. 20 is an exploded view of the panel shown in FIG. 18.

As seen in FIGS. 18 to 20, the backrest panel 6 has a general structure similar to that of the seat panel 4. It has a perimeter frame 51*a* with a mesh panel 52*a* attached thereto. The perimeter frame 51*a* has a continuous U-shaped portion 53*a* formed from thin-wall channel section sheet metal extending around its two sides and top end of the backrest panel 6 and a straight angle section thin metal portion 55*a* at the bottom end of the seat panel. A straight length of thin-wall hat-section steel extends as the strengthening reinforcing cross member 54*a* from one arm of portion 53*a* to the other arm of portion 53*a*. The perimeter frame portions 53*a* and 55*a* are welded to each other and also welded to the mesh panel 52*a* and to the cross member 54*a* in order to form a rigid unitary backrest panel construction.

The underside of the reinforcing member 54 carries a horseshoe shaped spring clip 62, fastened by two screws 63 to the cross member 54. The clip 62 grasps the forward extension 76 of the short strut 72 when the appliance is in the table configuration. The clip 62 clasps the long strut 70 when the seat panel 4 is lowered to the chair configuration. A pair of short cylindrical rubber buffers 64 are attached by stubs thereon into holes 65 on the cross member 54. Instead of stubs, screws could be used for the attachment. Each buffer 64 is aligned with a corresponding upper rail 23 of the side frames 24 and 25 when the seat panel 4 is lowered.

In the lowered position the seat panel 4 is prevented from sliding forward by two features which may be used alternatively, or in combination as shown in the presently described embodiment. The first of these features involves the retention of the buffers 64 against the side frames 16 and 18. The buffers 64 have a central cylindrical recess or bore 66 in their upper face. A tapered rubber stub (projection) 57 (shown in FIG. 13) is attached to each respective upper rail 23 in a position where, as the seat panel is lowered, the stub 57 neatly engages into the bore (recess) 66 of a respective buffer 64.

Alternatively, other forms of cooperating projections and recesses can be used for this purpose. The second feature preventing the seat panel sliding forward has, on the movable support member 14, a raised button which engages with the front edge of the clip 62 to prevent the seat panel slipping forward. The button 60 can be conveniently formed by a cylindrically headed screw screwed into the support strut 70.

The locating bracket 74 is formed from flat metal bent into a U-shape and, when it is supporting the tabletop, the upper edges 80 of the bracket 74 carry upwardly extending projections 82 which engage on either side of the frame members 55, 55*a* to which the hinge 5 is attached.

Figure 21:
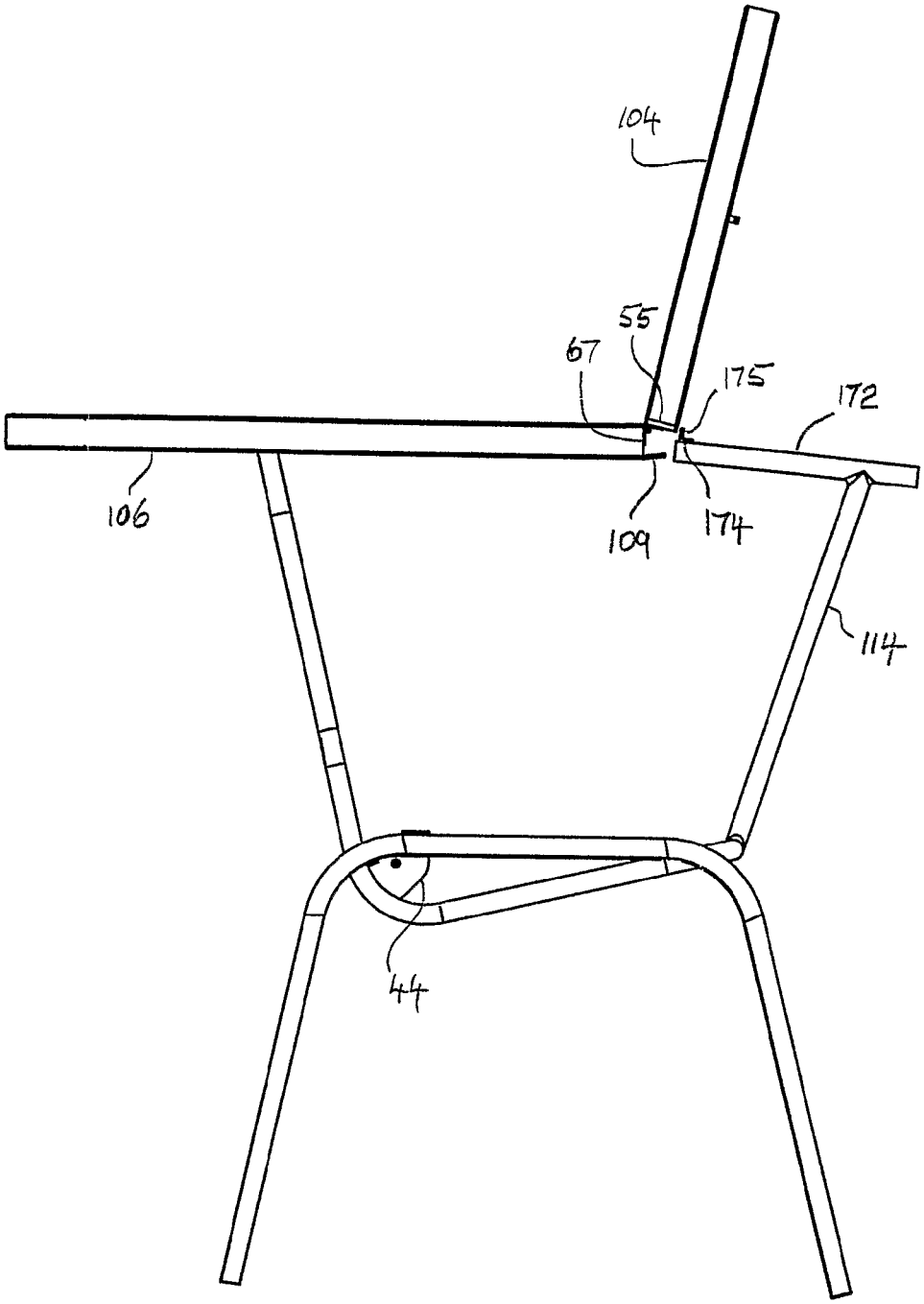
FIG. 21 is a side view of the convertible chair in FIGS. 1-4, shown part-way through its conversion.
Figure 22:
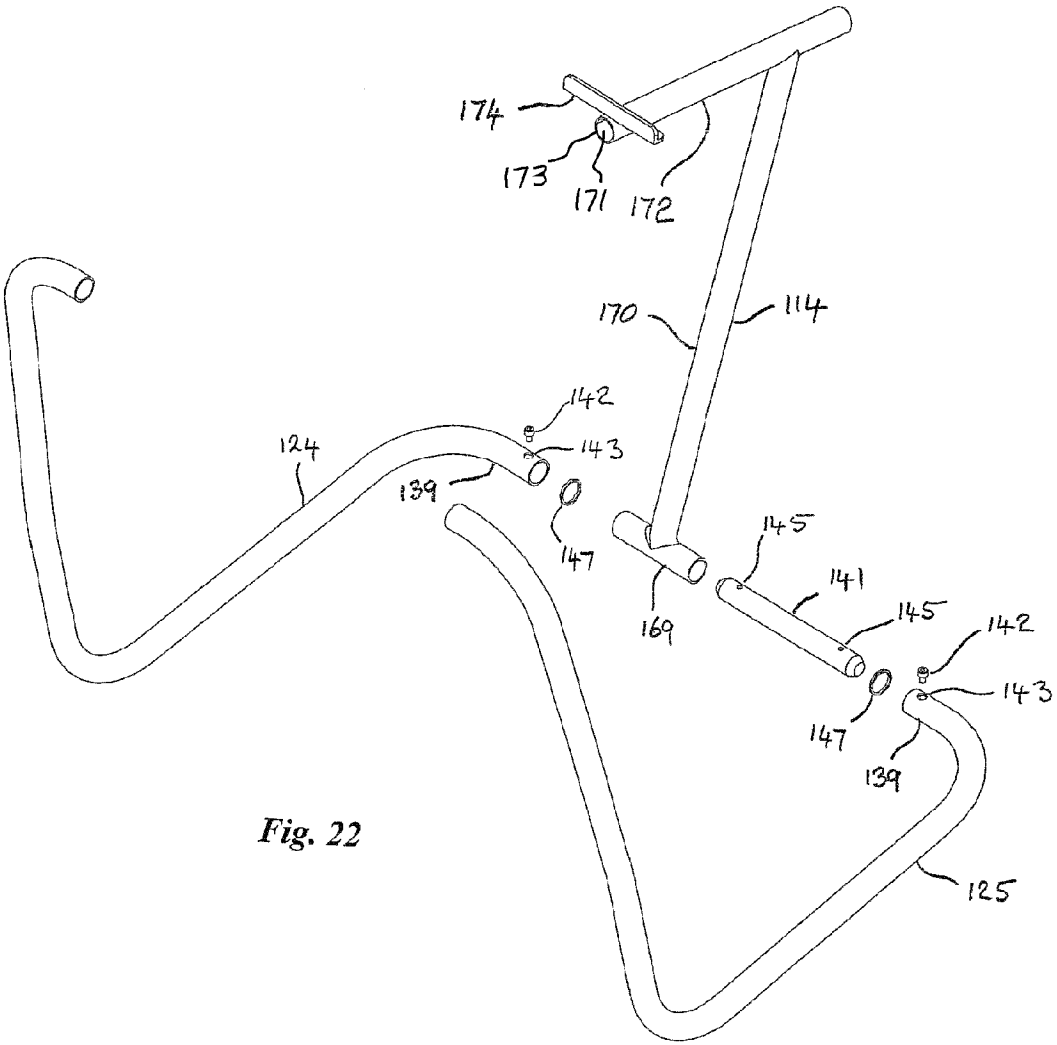
FIG. 22 is an exploded view of some components of the chair shown in FIG. 21.

Referring now to the second embodiment of the invention, shown in FIGS. 1 to 4 and 21 to 23, the lower face of the backrest panel 106 carries a short and narrow projecting clip 109 which locates into aperture 171 of short strut 172. The end of the short strut 172 also carries a short length of angle section metal 174 aligned so that one of its flanges 175 extends upwards when the support member is in the raised position as seen in FIGS. 21 and 22. When the appliance is configured to its table configuration, the flange 175 is clamped between the vertical aligned faces (hinged edges 98 and 99) of the respective straight frame portions 55 and 67. The flange 175 and metal section 174 are clamped members when the appliance is configured to its table configuration. The combination of the projecting tongue/protrusion 109 in the strut 172 and the clamped member 174 firmly locates the panels 104 and 106 relative to the movable support member 114.

Figure 23:
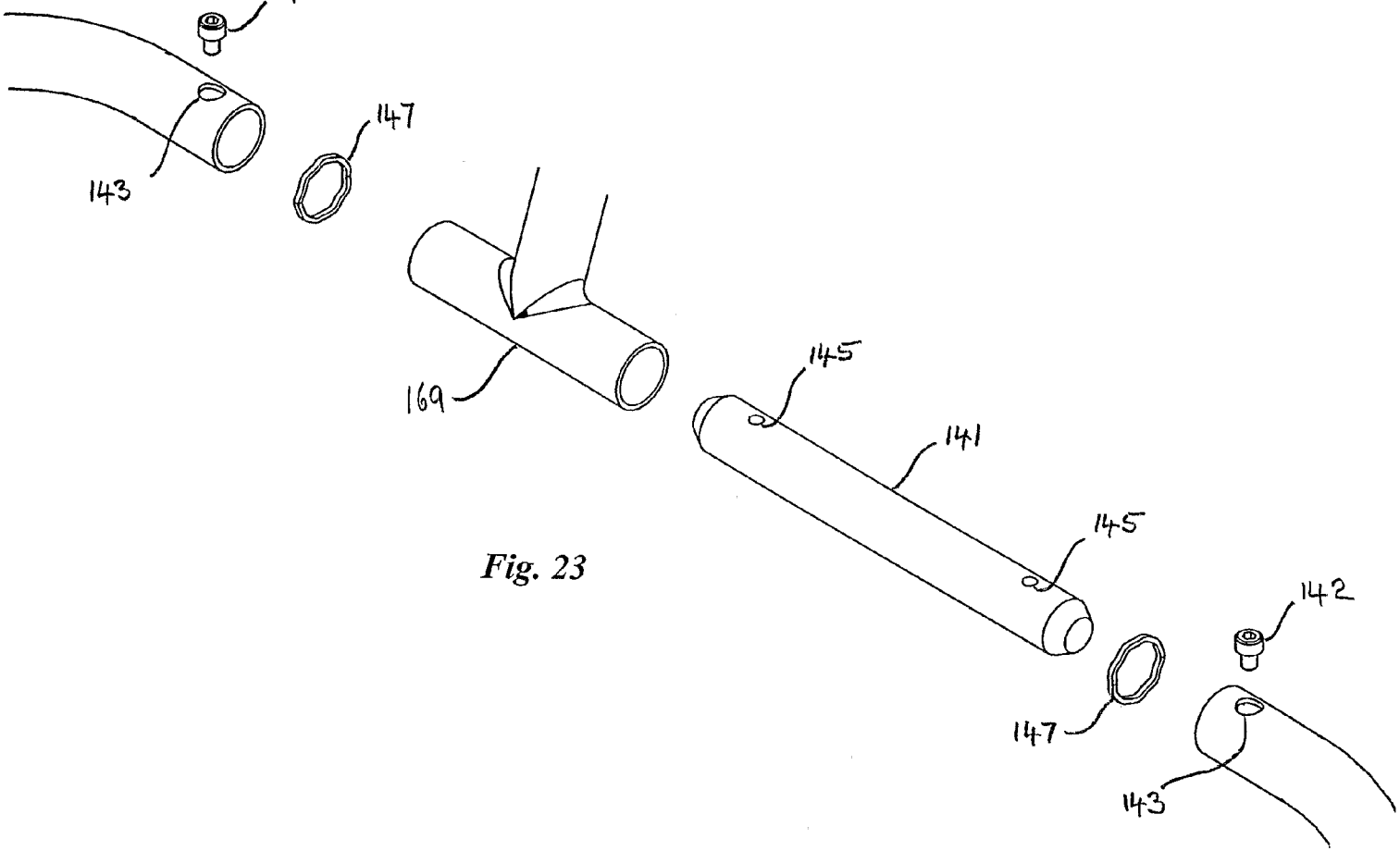
FIG. 23 is an enlarged view of portion of FIG. 22.
Figure 24:
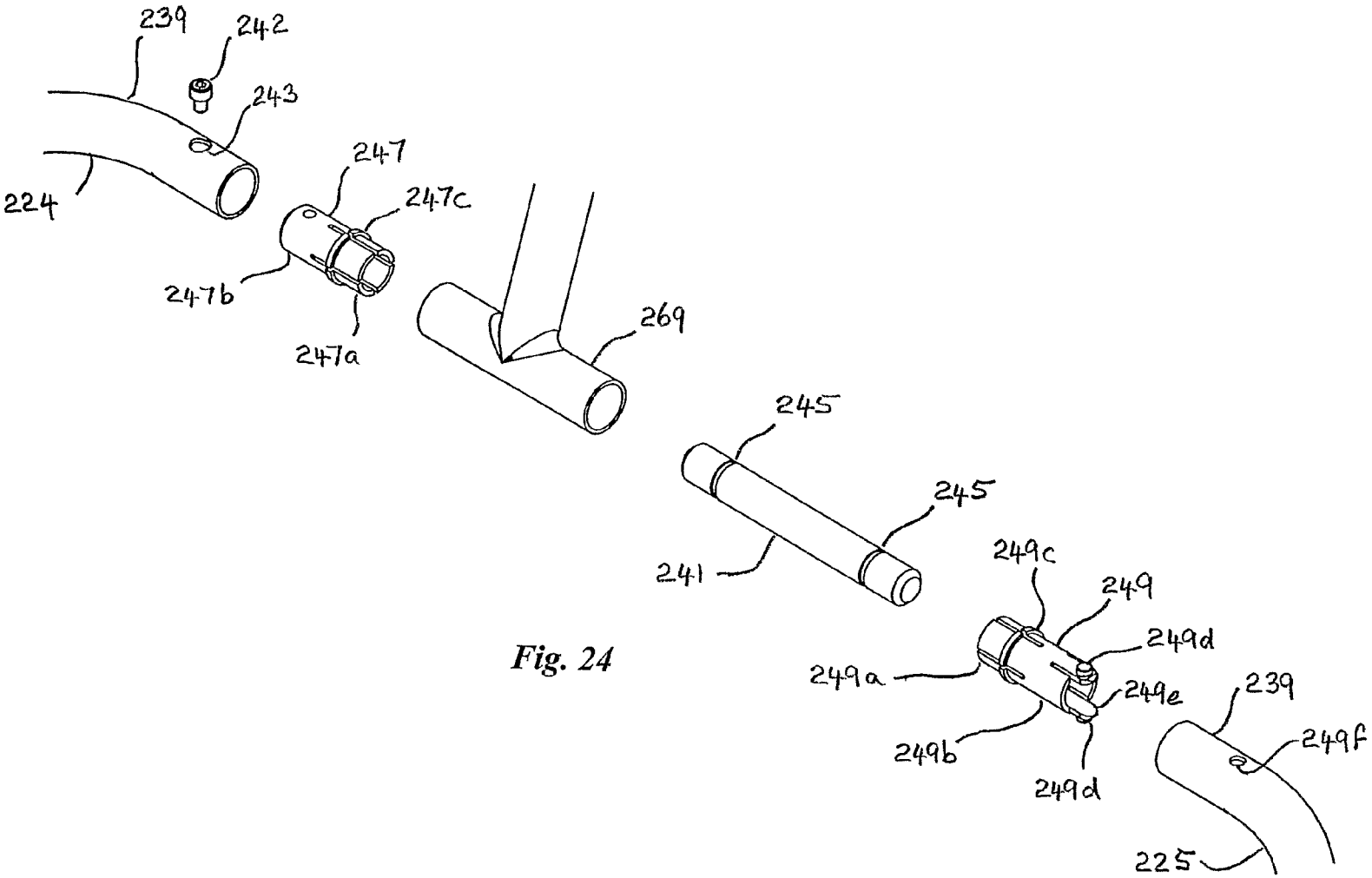
FIG. 24 is an exploded view corresponding to FIG. 23 but showing two alternative joining arrangements.
Figure 25:
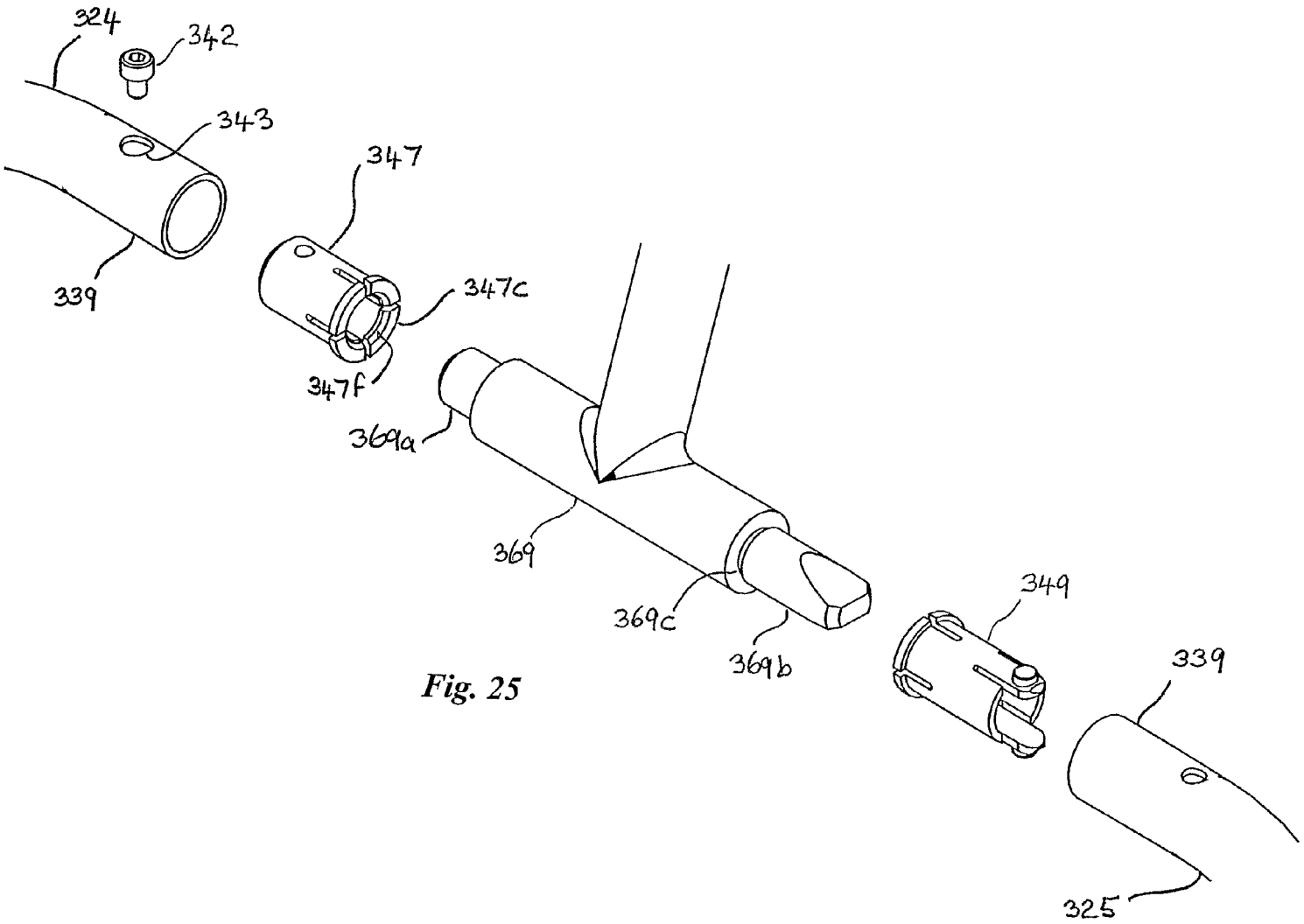
FIG. 25 is another exploded view corresponding to FIG. 23 but showing a further two alternative joining arrangements.

At the fixed end of the movable support member 114, the U-shaped bracket 69 of the embodiment described above is replaced by a short section of metal tube 169 welded at right angles to the long strut 170. Various means of attaching such a tube portion to the two side frames are illustrated in FIGS. 22 to 24. FIG. 25 illustrates the attachment of a solid shaft portion 369 which may be used as an alternative to the tube portion 169.

As seen from the exploded view in FIGS. 22 and 23, the tube 169 has inserted through it a shaft 141 which is a neat sliding fit within the tube 169. The shaft 141 is attached at each end to a respective lower end 139 of side frame upper portions 124 and 125 using screws 142 which pass through holes 143 in the frame portions 124 and 125 to screw into threaded holes 145 in the shaft 141. The shaft 141 is free to rotate within the tube 169 and wave-formed plastic washers 147 provide a low friction interface between each respective lower end 139 and the tube 169.

FIG. 24 illustrates two further alternative versions whereby a rotating bearing surface may be provided for the tube 269. The shaft 241 carries a circumferential groove 245 near each end. The shaft 241 is a neat fit at each end within respective plastic sleeves 247 and 249. In FIG. 24, two different forms of sleeve are illustrated. The tube 269 rotates upon the inboard portions 247*a* and 249*a* of the respective sleeves 247 and 249 while the outboard portions 247*b* and 249*b* are held fixed to their respective lower ends 239. The raised circumferential rib portions 247*c* and 249*c* respectively separate the ends 239 of the respective tubes from the tube 269. The sleeve 247 is attached to frame portion 224 by a screw 242 through a hole 243 in the tube and into the sleeve 247. The sleeve 249 is attached to the frame portion 225 by short cylindrical dimples 249*d* on flexible arms 249*e* which flex such that the dimples 249*d* snap fit into a pair of diametrically opposed holes 249*f*.

Two further alternative fastening systems are illustrated in FIG. 25. In these the tube 169 and 269 is replaced by a shaft 369 which has stepped ends 369*a* and 369*b* carrying cylindrical bearing surfaces. The example shown on the end 369*a* of the shaft 369 has a sleeve 347 fastened by a screw 342 through a hole 343 in frame portion 324 in the same manner as for sleeve 247. The sleeve 347 carries at its inboard end a flange member 347*c* having diametrically outwardly extending portions which act as a bearing face between the shaft 369 and the ends 339 of the frame portion 324. The flange member 347*c* on the inboard end of the sleeve also has multiple segments such that diametrically inward extending lips 347*f* which are carried on diametrically opposed flange segments which are flexibly displaceable diametrically outwardly so that when the sleeve is slipped over the bearing surface 369*a* of the shaft, the inwardly extending lips 347*f* snap fit into a circumferential groove 369*c* formed into the shaft at the inboard end of the bearing surface.

The second alternative fastening system shown at the other end of the shaft 369 has the inboard end of the sleeve 349 snap fitting into a groove 369*c* in the same manner as described for sleeve 347, and the outboard end of the sleeve snap fitting onto the end 339 of frame portion 325 in the same manner as described for sleeve 249 above.

Figure 26:
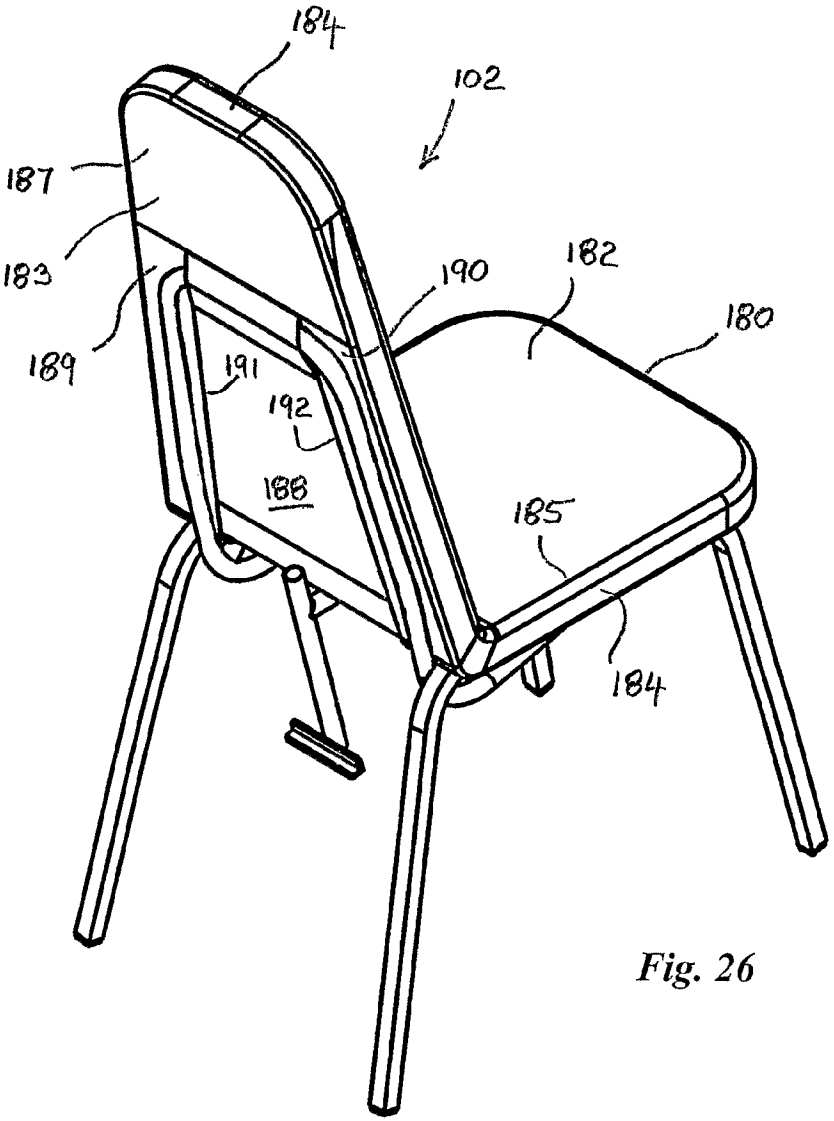
FIG. 26 is a rear perspective view of the chair in FIGS. 1-4 particularly showing a cover attached.

The cover 180 shown on the chair 102 in FIG. 26 is formed from heat resistant fabric suitable for use as a cover of an ironing board. In use a layer of suitable cushioning material would be interposed between the cover 180 and the underlying mesh. The cover 180 has a single piece upper face 182, a multi-piece rear or underface 183 and a single-piece gusset or edge panel 184 extending around its perimeter and joining the upper face 182 to the underface 183. The width of the edge panel 184 is the same as the thickness of the respective seat panel 4 and back rest panel 6 described earlier in relation to this invention so making a very neat tailored fit. The gusset 184 is joined to the upper face by a single seam 185 around the edge of the upper face 182 and the gusset is joined to the fabric of the underside 183 by a single lower seam 186 also.

The underside 183 comprises three panels of fabric. A first panel 187 extends across the end of the back rest panel 6 down as far as the top of the mainframe 12. From that end panel 187, the underside 183 extends as three separate sub-panels 188, 189 and 190 each joined at one of their ends to the end panel 187 and extending for the remainder of the length of the back rest panel and the seat panel. The central sub-panel 188 is joined by a respective zip fastener 191 and 192 on each side edge to the adjoining side sub-panel 189 and 190 respectively and the side sub-panels are in turn sewn to the gusset panel. In this way the central sub-panel 188 can extend to cover the top of the mainframe 112 and 113 while the side sub-panels pass the other side of the frame while still allowing the three sub-panels to be zipped together and so provide a neat looking finish to the covering of the appliance.

Figure 27:
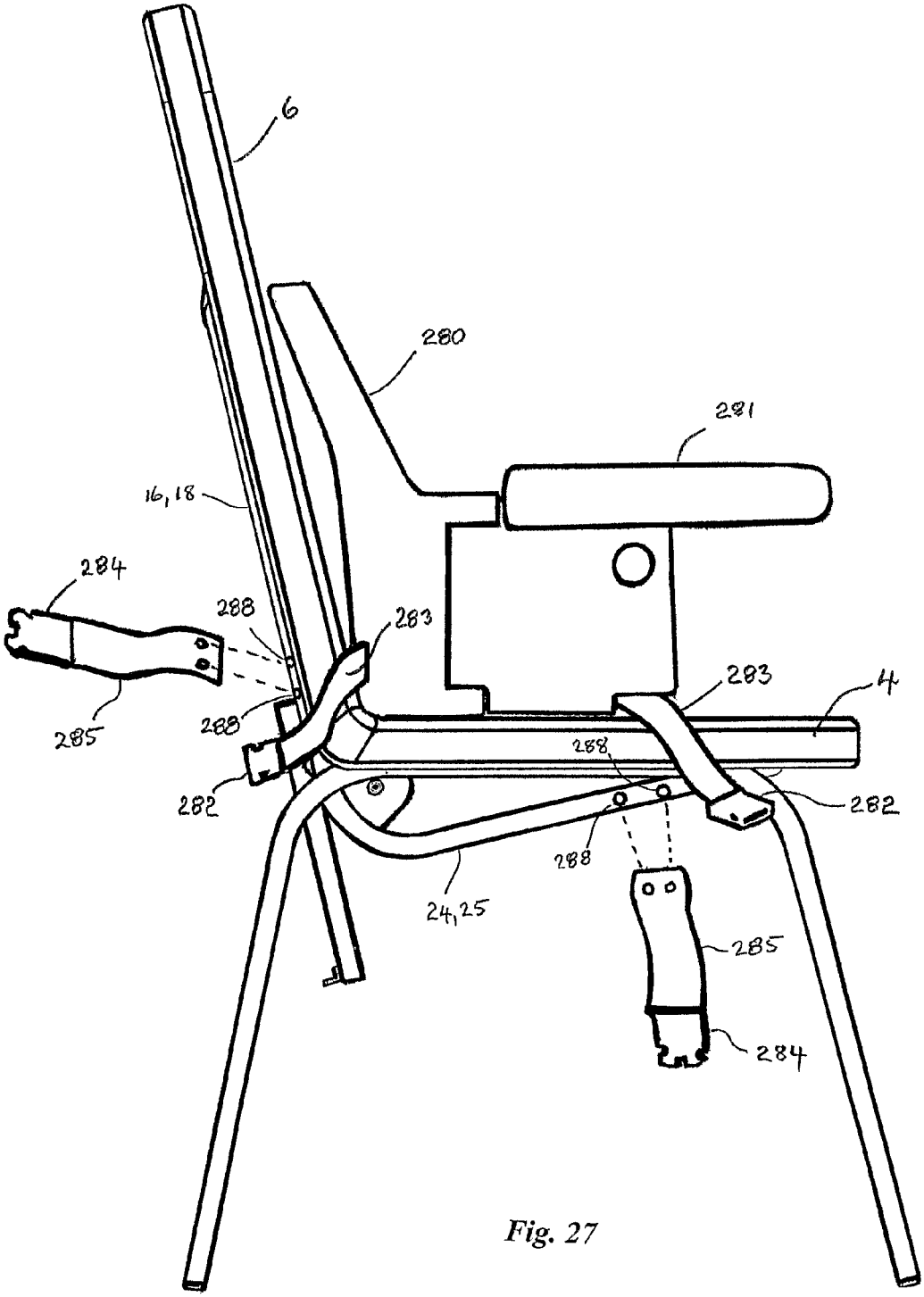
FIG. 27 is a side view of the chair in FIG. 26 shown with a child's booster seat fitted thereto.

In FIG. 27 a child's height raising seat 280 (also called a booster seat) is shown on the appliance 2 when it is configured in the form of a chair 10. Child booster seats are in themselves well known and provide for a child a seating surface which is raised from the seating surface of a chair on which the booster seat is positioned. In this way, the child can be raised to the height of a conventional table. Optionally, a tabletop may be provided attached to the booster seat. In this embodiment of the invention, the booster seat 280 is provided with a tabletop 281. Buckles 282 are attached to fabric webbing 283 which is in turn attached to the booster seat 280. Attached to the upper portions 24 and 25 of the side frames 16 and 18 of the seat are clips 284 or buckle portions which mate with the buckles 282 attached to the seat. The clips 284 may be fastened directly to the frame portions 24 and 25 or may be attached (as shown) to short lengths of webbing 285 which are in turn directly attached to the frame portions 24 and 25 of the appliance.

VELCRO® type hook and pile fastenings, or some other inter-engaging quick release fastenings may be used instead of buckles.

The attachment of clips and/or webbing to the frame portions 24 and 25 may be conveniently achieved by threaded fasteners located into holes 288 as indicated by dashed lines in FIG. 27, or may be achieved by any other convenient means such as clasps or clamps around the frame portions so as to not permanently mark the frame members. The positive attachment of the buckles and clips to the chair frame means that the booster seat is unable to move either sideways or forwards relative to the seat panel 4, and this is much safer than less secure situations where straps may be simply fastened around the seat panel or back rest panel.

Figure 28:
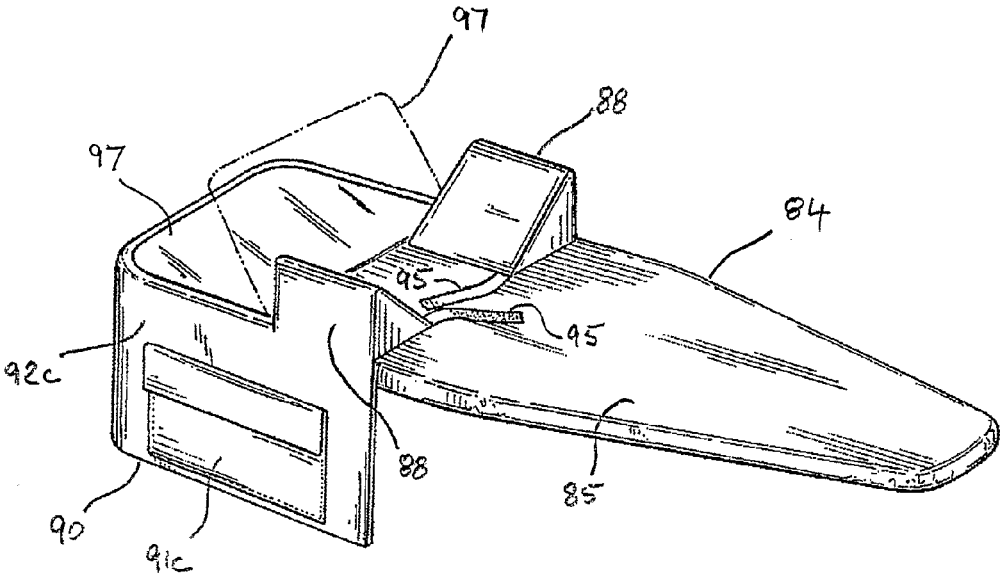
FIG. 28 is a perspective view, from above, of the seat panel and the backrest panel when raised to form a table and covered by an overlay for use when changing clothing of a baby.
Figure 29:
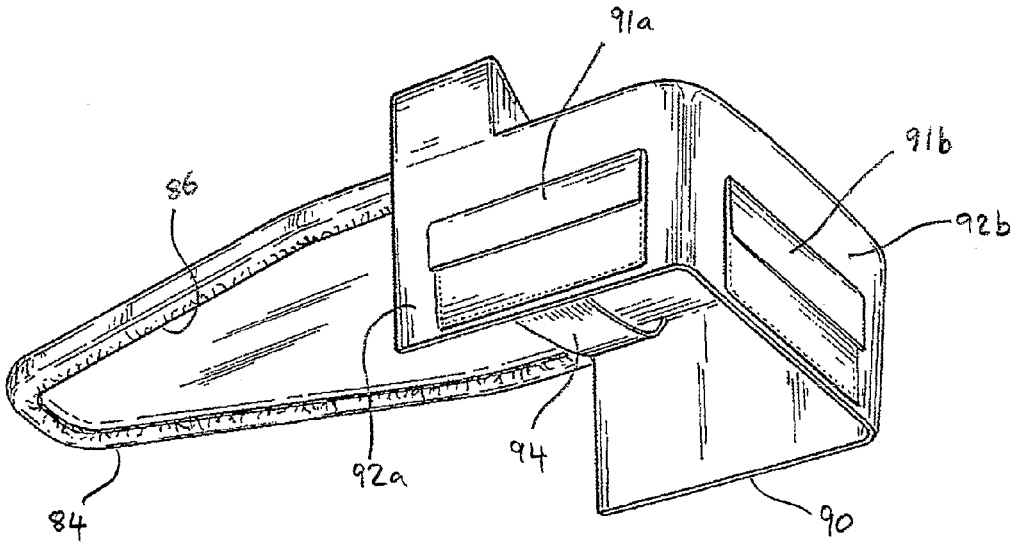
FIG. 29 is a perspective view, from below, of the combination shown in FIG. 28.

Referring now to FIGS. 28 and 29, the appliance in its raised position is covered by an overlay 84 which is made of fabric and sized to neatly fit the ironing-board shape of the table. A main cover portion 85 made of fabric (preferably a waterproof fabric) has a skirt portion 90 which extends along three sides towards the squared-off end of the table formed by the underlying seat panel 4. An elasticised edge 86 along the edge of the main cover portion 85 at the other end of the table serves, when it is slipped under the table, to stretch the cover across the table.

The skirt 90 has formed into it a pocket 91*a* 91*b* and 91*c* on each of the skirt's three faces 92*a*, 92*b* and 92*c*. The underside of the overlay carries a VELCRO® type hook and pile fastened belt 94 to more firmly retain the cover on the table. A pair of wedge-shaped bolsters 88 are positioned to prevent a baby rolling sideways. A pair of VELCRO® type hook and pile fastened straps 95 are provided to restrain the baby. An optional removable flap 97 may be incorporated as shown by phantom lines in FIG. 28. The flap 97 is attached to the main cover portion 85 by a VELCRO® type hook and pile strip or patches which are not visible in FIG. 28. The flap 97 is most conveniently made of a waterproof fabric in order to prevent leakage of moisture from a baby being changed thereon. Although the main cover portion 85 may be made from waterproof fabric, the additional removable flap allows convenient clean up after a particularly messy change of baby clothing has been made.

Figure 30:
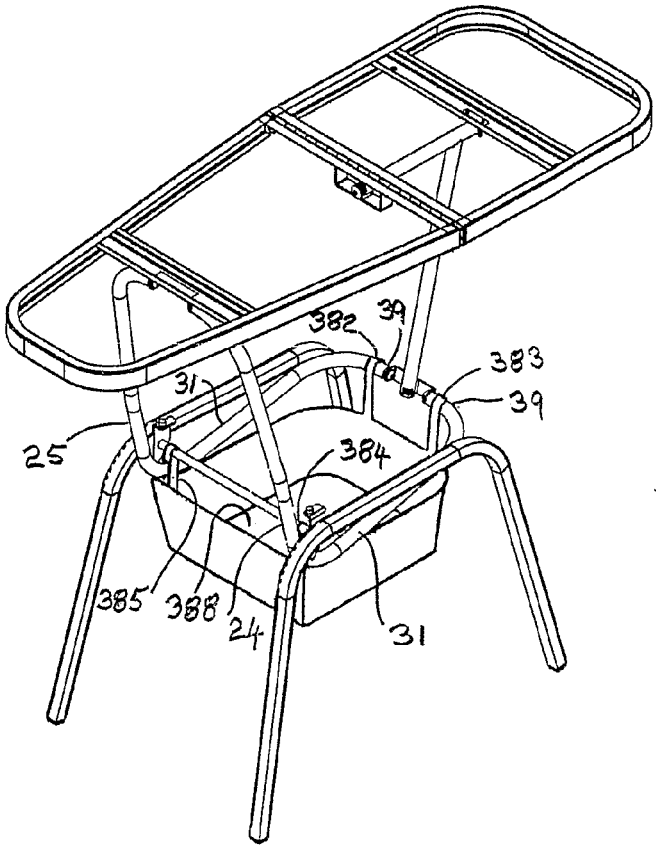
FIG. 30 is a view of the framework of the table configuration shown in FIG. 9 together with a first type of attached bin.
Figure 31:
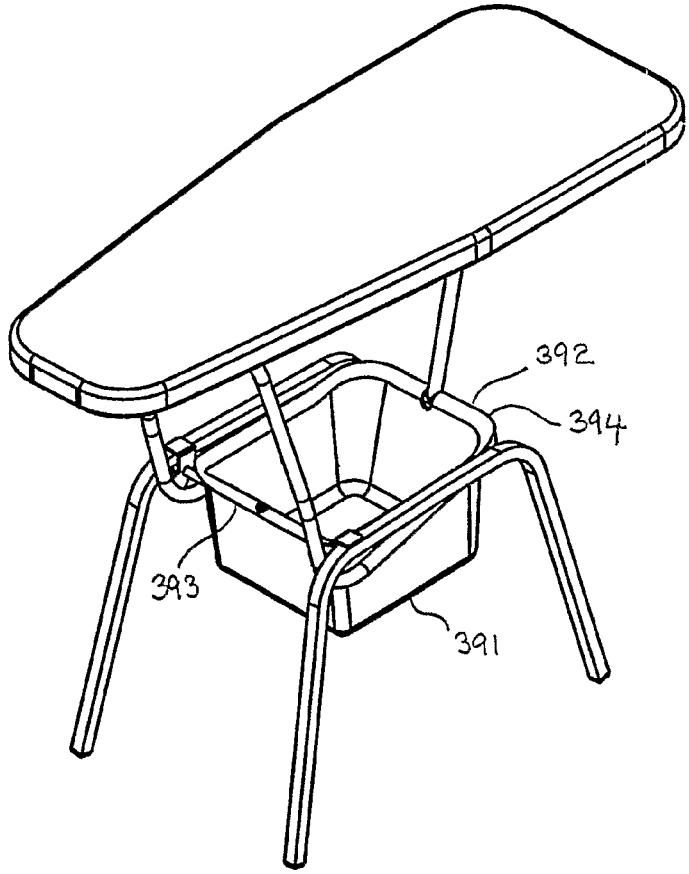
FIG. 31 is a view of the table configuration together with a second type of attached bin.

Referring to FIG. 30, a bin 380 is suspended by four hooks 382 to 385 formed thereon which hang from the connecting bar 20 and the ends 39 of the side frames. The front hooks 382 and 383 are longer than the rear hooks 384 and 385 in order that the base 388 of the bin 380 will rest horizontally. The bin is sized so that it may be conveniently lowered into position between the straight portions 31 of the side frame portions 24. The bin may be solid-walled as illustrated in FIG. 30 or may have a wire mesh construction. Instead of having separate hooks as shown, the bin may instead have outwardly extending lips on its upper edge which engage the frame portions 24 and 25. Alternatively, as shown in FIG. 31, the bin 391 may have outwardly extending lips 392 and 393 on its upper edge 394 which engage the connecting bar 20 and the frond ends 39 of the upper portions of the side frames.

Figure 32:
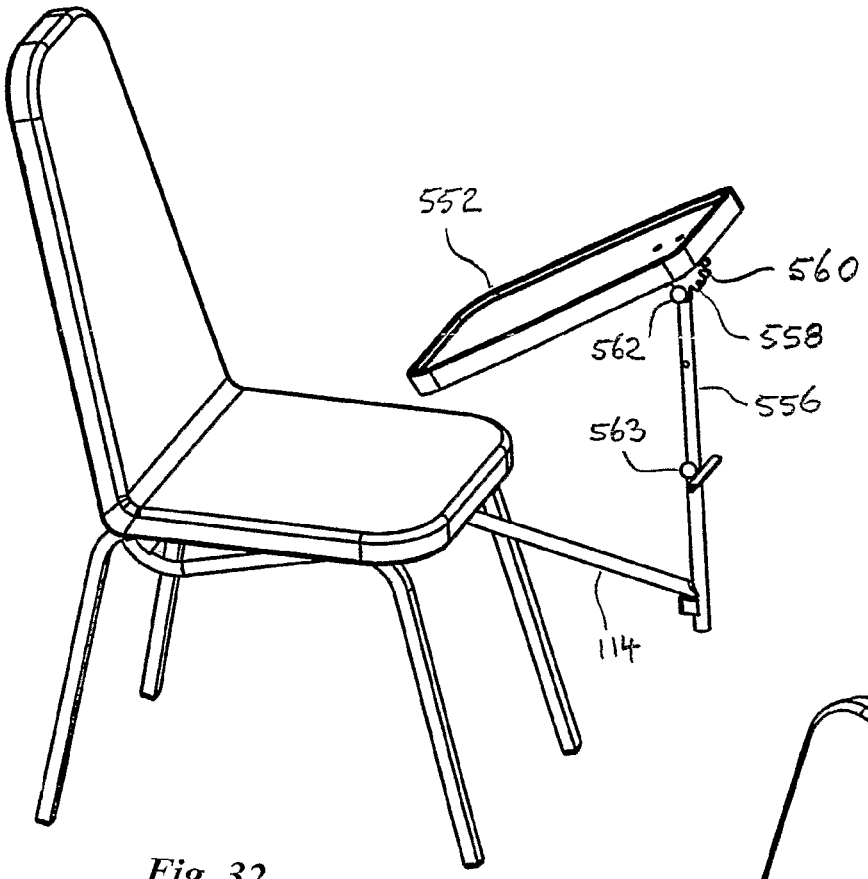
FIG. 32 is a view of the chair in FIGS. 1-4 together with an auxiliary work surface attached thereto.

Referring now to FIGS. 32 to 35, a panel 552 which provides an auxiliary flat firm work surface 554 is seen attached to the chair 2. The work surface is suitable for reading or writing while sitting on the chair. In its operating position as shown in FIG. 32, the panel 552 is supported on a tubular support post 556 which is pivotally connected to the panel by means of a bracket 558 mounted on the rear of the panel. The bracket is provided with a toothed quadrant 560 whereby a screw 562 through the post 556 may be used to engage the teeth in the quadrant and thereby provide a firm adjustment of the angle of the work surface. The post 556 is held upright by it being inserted into the end 173 with aperture 171 of the short strut 172 of the moveable support 114. The post is somewhat longer than, and is a neat sliding fit inside, the tubular strut 172. The height of the work surface is adjustable by loosening and tightening the screw knob 563. The moveable support is held in its position extending out in front of the chair by means of a suitable clip (not shown) mounted to the underside of the front of the seat frame portion 53. The moveable support 114 is swung forward when required and may be swung back for storage as shown in FIG. 26. A user most conveniently sits on the chair with the long strut between their legs and angled downwards away from them.

Figure 34:
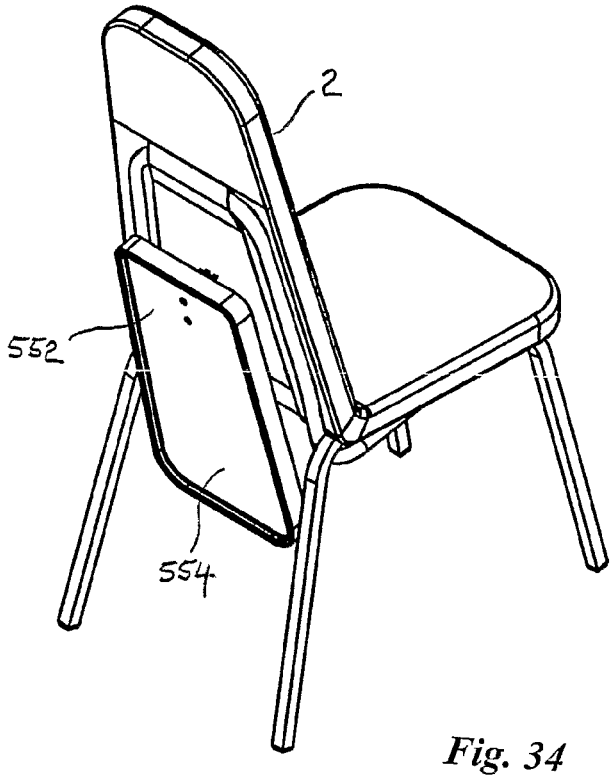
FIG. 34 is a view of the chair in FIG. 32 with the work surface stowed in a first position.
Figure 35:
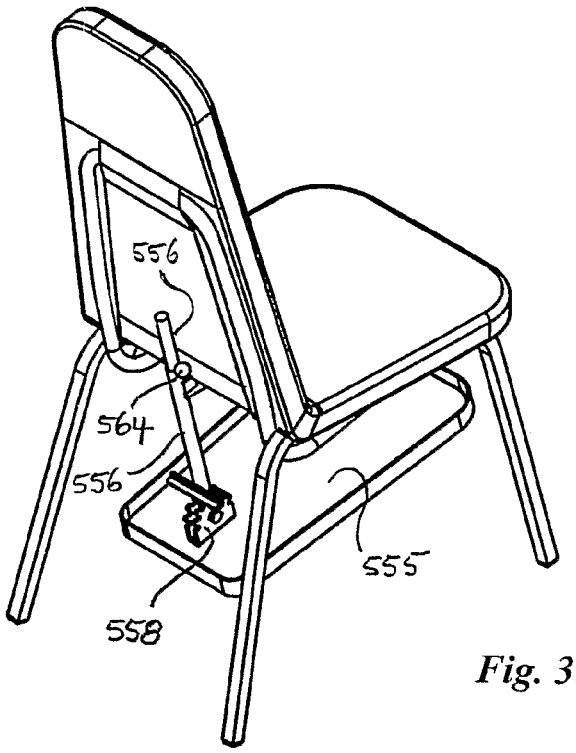
FIG. 35 is a view of the chair in FIG. 32 with the work surface stowed in a second position.

When the moveable support member 114 is swung back in this manner, it may still be utilised for storing the panel 552 as illustrated in FIGS. 34 and 35. In FIG. 35 the post 556 has been slid into end 173 with aperture 171 of the short strut 172, whereas in FIG. 34 the post 556 has been slid into the opposite end of the short strut 172. In FIG. 34 the post 556 is folded flat against the rear of the panel 552 so that the panel lays neatly adjacent the back of the chair. In FIG. 35 the post 556 is opened out from the panel so that the rear 555 of the panel forms a shelf beneath the seat of the chair. The screw 563 is tightened to prevent the post sliding out of the strut 172 and the screw 562 engaging with the teeth on the quadrant 560 prevents the panel 552 from tilting.

Figure 33:
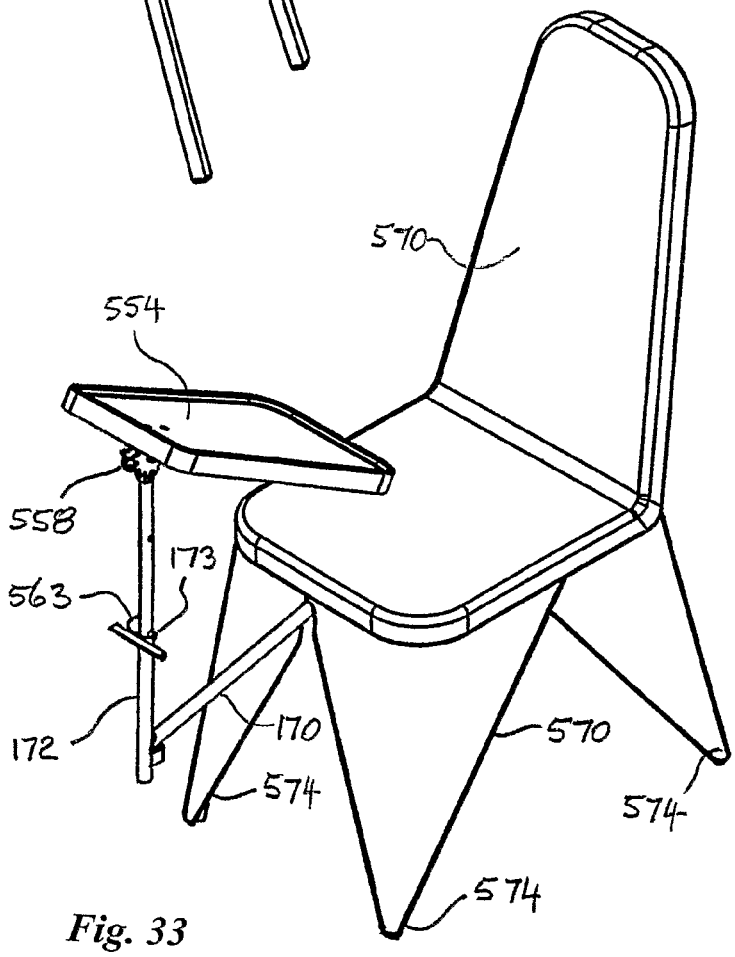
FIG. 33 is a view of the chair in FIG. 32 with an additional decorative cover fitted thereto.

FIG. 33 shows a cover 570 on the chair. Four triangular skirt portions extend from the corners of the seat to the floor. The bottom corners 574 are fastened by fabric or elastic loops to the bottom of the chair legs. The cover 570 provides a decorative feature by changing the appearance of the chair considerably, while still permitting the support member 114 to be swung forward as shown in FIG. 33, or swung back as shown in FIG. 26.

Whilst the above description includes the preferred embodiments of the invention, it is to be understood that many variations, alterations, modifications and/or additions may be introduced into the constructions and arrangements of parts previously described without departing from the essential features or the spirit or ambit of the invention.

It will be also understood that where the word "comprise", and variations such as "comprises" and "comprising", are used in this specification, unless the context requires otherwise such use is intended to imply the inclusion of a stated feature or features but is not to be taken as excluding the presence of other feature or features, support to the hinge (105).

The invention claimed is:

1. A furniture item convertible between a chair configuration and a table configuration, said furniture item comprising:

a first panel portion hinged to a second panel portion at respective hinged edges, said panel portions being moveable between:

respective first positions, when in said chair configuration, in which said first panel portion adopts a generally horizontal orientation to provide a seat for a user to sit upon and said second panel portion adopts a generally upright orientation to provide a backrest for said seated user to lean against, and respective second positions, when in said table configuration, in which said panel portions align to form a table top having a substantially flat upper surface; and a rigid frame extending behind said second panel portion when in said chair configuration, and extending under said second panel portion when in said table configuration, a pivotal connection connecting said frame and said second panel portion whereby said second panel portion may be tilted thereby raising or lowering said first panel portion between its said first and second positions, a moveable support means comprising:

a first strut attached by a rotary connection to said frame, said rotary connection having an axis of rotation, such that the first and second struts, as well as, the rotary connection fall in the same plane, and a second strut rigidly attached to that end of said first strut distal from said rotary connection, said first and second struts together occupy an approximate planar form of rotary motion orthogonal to said axis of rotation, adapted for flat-packing, said moveable support means being rotatable between a stowed position beneath said first panel portion when in the chair configuration and a raised position in which said moveable support member provides support to the underside of said first panel portion and support to said hinge, a panel retention means located at that end of said second strut distal from said first strut, said panel retention means including:

an aperture which receives a clip extending from said second panel portion, and a flange which extends between said panel portions at the hinge;

whereby, when in said table configuration, upward movement of the second panel portion is prevented by said clip in said aperture and movement of said second strut is resisted by said flange being clamped between said hinged edges of said panel portions, and wherein the furniture item has a first and second side frame approximately 40% of the width of the furniture item to enable flat pack packaging for storage or shipment.

2. The furniture item according to claim 1 wherein cooperating projections and recesses are provided on said frame and said first panel portion whereby, when in said chair configuration, said projections and recesses inter-engage to resist forward sliding of said first panel portion.

3. The furniture item according to claim 1 wherein a basket or bin-like receptacle is suspended from said frame when in said table configuration.

4. The combination of a furniture item according to claim 1, when in said chair configuration, together with a child's height raising seat held against said first panel portion, said frame having fastened by threaded fasteners thereto at least one pair of straps carrying inter-engaging quick release fastenings, said height raising seat being held against said first panel portion by said straps tensioned and fastened together.

5. The combination of a furniture item according to claim 1, when in said table configuration, together with an attached overlay for use when changing the clothing of a baby, said overlay comprising:

a cover portion adapted to cover said table surface, a skirt portion which hangs down from edges of the table around one end of the table, elastic edges on the cover portion towards the other end of the table which stretch the cover from beneath the table, bolster structures fastened to the cover in a position to prevent the baby rolling sideways off the table; and pockets in the skirt portion.

6. The combination according to claim 5 wherein the overlay is held in place on the table surface by a releasable belt the ends of which extend from two edges of the cover portion and are releasably fastened below said table top.

7. The combination according to claim 5 wherein straps extend from the cover portion at the bolster structures whereby the straps may be releasably fastened in order to secure the baby onto the table.

8. The combination according to claim 6 wherein the releasable fastening of said belt is by hook and pile type fastenings.

9. The combination according to claim 7 wherein the releasable fastening of said straps is by hook and pile type fastenings.

10. The furniture item according to claim 1, when in said chair configuration, wherein a panel suitable for supporting reading or writing material is supported in front of the chair by said moveable support means.

11. A kit of parts to assemble the furniture item of claim 1.

12. The furniture item according to claim 1 wherein cooperating projections and recesses are provided on said frame and said first panel portion whereby, when in said chair configuration, said projections and recesses inter-engage to resist forward sliding of said first panel portion.

13. The furniture item according to claim 1 wherein a basket or bin-like receptacle is suspended from said frame when in said table configuration.

* * * * *